US006655132B2

(12) United States Patent
Bouchez et al.

(10) Patent No.: US 6,655,132 B2
(45) Date of Patent: Dec. 2, 2003

(54) COMBUSTION CONTROL BY PARTICLE FILTER REGENERATION

(75) Inventors: Matthias Bouchez, Meudon (FR); Jean-Baptiste Dementhon, Paris (FR)

(73) Assignee: Institut Francais du Petrole, Rueil-Mailmaison-cedex (FR)

( * ) Notice: Subject to any disclaimer, the term of this patent is extended or adjusted under 35 U.S.C. 154(b) by 146 days.

(21) Appl. No.: 09/959,126

(22) PCT Filed: Feb. 21, 2001

(86) PCT No.: PCT/FR01/00505

§ 371 (c)(1),
(2), (4) Date: Dec. 19, 2001

(87) PCT Pub. No.: WO01/63103

PCT Pub. Date: Aug. 30, 2001

(65) Prior Publication Data

US 2002/0157383 A1 Oct. 31, 2002

(30) Foreign Application Priority Data

Feb. 22, 2000 (FR) ..... 00 02216

(51) Int. Cl.[7] ..... F01N 3/00
(52) U.S. Cl. ..... 60/295; 60/311; 60/300
(58) Field of Search ..... 60/282, 311, 284, 60/295, 297, 300, 303; 55/DIG. 30

(56) References Cited

U.S. PATENT DOCUMENTS 4,567,725 A * 2/1986 Shinzawa et al. ..... 60/274
4,574,589 A * 3/1986 Hasegawa et al. ..... 60/286
4,631,076 A * 12/1986 Kurihara et al. ..... 55/283
4,677,823 A * 7/1987 Hardy ..... 60/274
4,715,179 A * 12/1987 Muller et al. ..... 60/274
5,050,376 A * 9/1991 Stiglic et al. ..... 60/274
5,524,433 A * 6/1996 Adamczyk, et al. ..... 60/276
5,850,735 A * 12/1998 Araki et al. ..... 60/274
6,167,696 B1 * 1/2001 Maaseidvaag et al. ..... 60/274
6,233,927 B1 * 5/2001 Hirota et al. ..... 60/297
6,272,848 B1 * 8/2001 Okude et al. ..... 60/274

* cited by examiner

*Primary Examiner*—Thomas Denion
*Assistant Examiner*—Diem Tran
(74) *Attorney, Agent, or Firm*—Antonelli, Terry, Stout & Kraus, LLP

(57) ABSTRACT

Process and device for controlling the regeneration of an element filtering oxidable particles carried along by a gaseous stream, by periodic combustion of these particles, such as, for example, the carbon-containing particles carried along in the exhaust gas of a thermal engine (3), retained in an exhaust silencer (1).

In an application to a thermal engine, the process comprises detecting the variation, measured by detectors (4, 5), in the oxygen content of the gaseous stream between at least a first point located upstream, in relation to the direction of flow, from filtering element (1) receiving the stream and at least a second point located downstream from the first one, resulting from a reaction of combustion of the particles accumulated in the filtering element, initiated by a management element (6) acting for example on the running of engine (3), which allows the latter to adjust with precision the stage of regeneration of the filtering element and therefore to limit overconsumption as far as possible.

9 Claims, 2 Drawing Sheets

COMBUSTION CONTROL BY PARTICLE FILTER REGENERATION

FIELD OF THE INVENTION

The present invention relates to a process and to a device for controlling the regeneration of a system for collecting carbon-containing elements, such as a particle filter installed on a gaseous flow system, for example in an internal-combustion engine, by means of differential measurement of the fuel/air ratio of the gas at the boundaries of the filtering element.

BACKGROUND OF THE INVENTION

The filtering means allow to collect the particles discharged at the exhaust of an internal-combustion engine with high filtering efficiencies of the order of 80%. The cordierite-based ceramic monolith marketed by the Corning company, the silicon carbide-based ceramic monolith marketed by the Ibiden company or cartridges with wound ceramic fibers can be mentioned by way of example.

The technical difficulty encountered when developping and installing particle filters lies in the fact that they must be periodically regenerated by combustion of the soot deposit in order to prevent clogging of the filtering element, which will penalize the engine efficiency and imperil the working order of the engine. This combustion sometimes occurs naturally when the temperature of the gas flowing through the filter reaches a sufficient level to initiate oxidation of the particles. However, the temperature levels encountered at the exhaust of Diesel engines for example remain, within a very wide operating range, much too low to allow initiation of the soot combustion. It is then necessary to implement actions allowing to initiate regeneration of the filter.

Many techniques have been developped to that effect. They can be based on changes in the engine running parameters, such as the EGR ratio, supercharging, the injection delay, throttling at the exhaust, throttling at the intake, they can be linked with the use of an oxidation catalyst placed upstream from the filtering element coupled with a post-injection, or they can involve an external energy supply to the exhaust gas or in the filter by means of resistors, burners, micro-waves, plasma, etc. It is then necessary to drive these various devices by means of an external control operated by the computer.

The criterion for initiating regeneration of the filtering element can be the back pressure variation or pressure drop measured at the boundaries of the filtering element, which can be correlated with its fouling level due to the soot, as described for example in patent FR-2,755,623 filed by the applicant. This detection process is very suitable under stabilized running conditions. Measurement of the back pressure also allows to detect the combustion of the soot accumulated in the filtering element because, under stabilized running conditions, it drops with the combustion of the carbon-containing deposit. However, the back pressure at the exhaust is subjected to great fluctuations when the engine conditions are not stabilized (temperature, air flow rate, etc.). This is the case for the engine of a vehicle that, under usual traffic conditions, very often works under transient conditions (acceleration, deceleration). Controlling the fouling level of a filtering element by means of this type of measurement is difficult in practice.

Initiation of the regeneration of the filtering element can also be controlled by measuring the resistor variation measured between points spaced out along the filtering element, a variation that is directly linked with the fouling level thereof as described for example in patent FR-2,760,531 filed by the applicant.

Regeneration of the filter can be facilitated by using additives in the fuel based, for example, on organometallic or rare-earth elements, that are found in the soot deposit and catalyse the oxidation of the soot, which leads to a fall in the combustion initation temperature for the carbon-containing deposit. Cerium, strontium, iron, etc., can be mentioned as examples of the most commonly used products. Using these elements allows to obtain regenerations at temperatures ranging between 200° C. and 450° C. according to the nature of the soot deposit. However, the temperatures encountered for example at the exhaust of supercharged Diesel engines can remain, for certain types of use such as urban traffic, insufficient for initiation of the combustion of soot. Implementation of specific strategies involving the various elements mentioned above becomes essential for the system to work properly. Various examples of use of these various techniques are described for example in the following patents: EP-913,559, JP-10,141,113, GB-2,261,613, EP-488,386 or DE-35,38,109.

Whatever the means used for initiating regeneration of the filtering element, it causes energy consumption. Good management of the system requires control of the regeneration stage. More precisely, detection of the filter regeneration start allows to define the moment when the means used for increasing the temperature of the gas can be stopped. Combustion of the soot can then be self-sustained because of the high exothermicity of the soot oxidation reaction. This notably leads to a limitation of the overconsumption of the engine linked with the implementation of the strategies for regenerating the filtering element.

SUMMARY OF THE INVENTION

The present invention allows very efficient control of the stage of regeneration of the filtering elements and of the operations required to clean them.

The process according to the invention allows to control the periodic regeneration of an element filtering particles that are carried along by a gaseous stream, through combustion of these particles. It is characterized in that it comprises detecting the variation in the oxygen concentration of the gaseous stream between at least a first point located upstream from the filtering element receiving the stream, in relation to the direction of flow thereof, and at least a second point located downstream from the first point, resulting from a triggered reaction of combustion of the particles accumulated in the filtering element, so as to adjust with precision the warming up time required for initiation of the combustion and therefore to limit the energy required as far as possible.

According to an embodiment, the process allows for example to control the periodic regeneration of a filtering element such as an exhaust silencer, intended to retain particles or soot carried along by a gaseous stream flowing out of an engine, by combustion of these particles. It is characterized in that it comprises detecting the variation in the fuel/air ratio of the exhaust gas between at least a first point located upstream from the filtering element in relation to the direction of flow and at least a second point located downstream therefrom, resulting from a reaction of combustion of the particles accumulated in the filtering element, initiated by a management element sensitive to the detected fuel/air ratio variation, so as to adjust with precision the warming up time required for initiation of the combustion.

In some cases, the process can comprise controlling the spontaneous regeneration of the filtering element or initiating an action on the engine running parameters in order to obtain a substantial exhaust gas temperature rise, or initiating heating means associated with the filtering element.

The device according to the invention allows to control the periodic regeneration of a filtering element that retains particles carried along by a gaseous flow, by combustion of these particles. It is characterized in that it comprises means for detecting the variation in the oxygen content of the gaseous stream between at least a first point located upstream from the filtering element receiving the stream, in relation to the direction of flow thereof, and at least a second point located downstream therefrom (preferably downstream from the filtering element), heating means intended to raise the temperature of the filtering element sufficiently to burn the particles, and management means connected to the detection means in order to adjust the warming up time required for initiation of the combustion, by acting on the heating means.

In an application to the control of the periodic regeneration of a filtering element that retains oxidable particles or soot carried along by a gaseous stream flowing out of a thermal engine, by combustion of these particles, the device comprises a first fuel/air ratio detector arranged at a first point located upstream from the filtering element in relation to the direction of flow and a second fuel/air ratio detector arranged at a second point located downstream from the first one (preferably downstream from the filtering element), in relation to the direction of flow of the gas, heating means intended to raise the temperature of the filtering element sufficiently to burn the particles, and a computer connected to the detection means so as to adjust the warming up time required for initiation of the combustion, by acting on the heating means, according to the fuel/air ratio variation of the exhaust gas between the first and the second detector.

The heating means can for example consist of the engine, the computer being programmed to modify the running parameters intended to raise the temperature of the exhaust gas, or they can be associated with the filtering element.

BRIEF DESCRIPTION OF THE DRAWINGS

Other features and advantages of the process and of the device according to the invention will be clear from reading the description hereafter of a non limitative embodiment example, in a particular application where the gaseous stream comes from a thermal engine, with reference to the accompanying drawings wherein.

DETAILED DESCRIPTION

Figure 1:
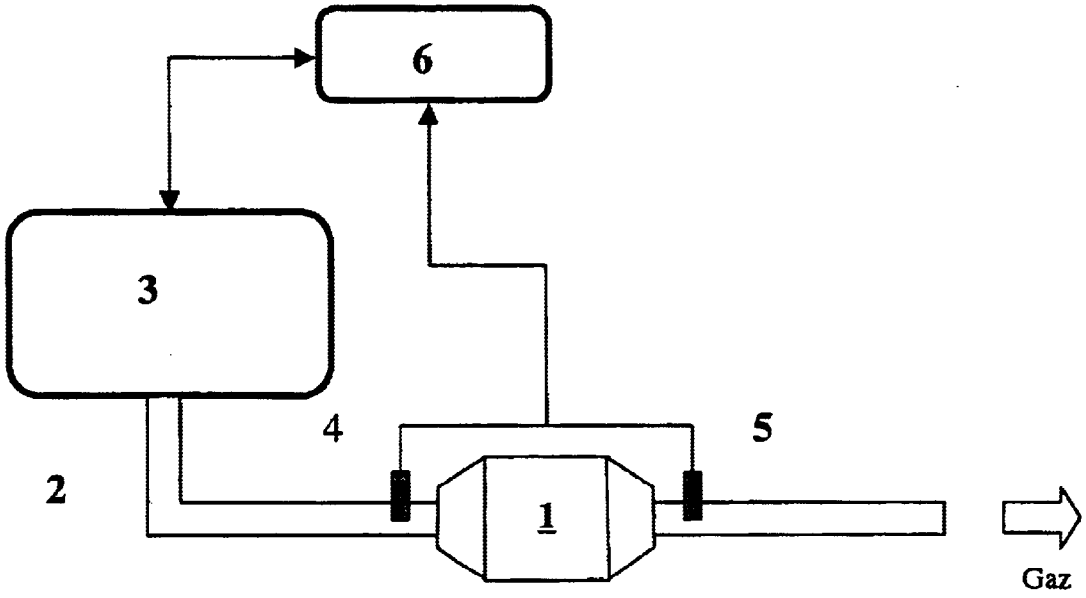
FIG. 1 diagrammatically shows a control device applied to monitoring of the fouling of a filtering element at the outlet of an engine.

The device is suited, in the described application, for controlling the periodic regeneration of a filtering element 1 interposed on an exhaust circuit 2 of a thermal engine 3, by combustion of carbon-containing polluting particles (soot) that accumulate therein, by detecting the fuel/air ratio variations between upstream and downstream from the filtering element due to this combustion.

The term fuel/air ratio is taken here in its particular sense used by motormen and defined by the following relation:

Fuel/air ratio=(m_fuel/m_air)/(m_fuel/m_air)stoich, where m_fuel is the mass of fuel injected into the engine (kg/h), m_air the mass of air drawn by the engine (kg/h), and (m_fuel/m_air) stoich corresponds to the ratio between the fuel flow rate and the air flow rate at the combustion reaction stoichiometry. This ratio depends on the nature of the fuel and it is close to 1/14.5.

In order to measure this fuel/air ratio variation, the device comprises a first fuel/air ratio detector 4 of a well-known type, such as those that are currently encountered in the exhaust circuits of engines, arranged here upstream from filtering element 1 in relation to the direction of flow of the exhaust gas, for example. It also comprises at least a second fuel/air ratio detector 5 of the same type, arranged downstream from first detector 4, near to the outlet of filtering element 1 for example. Fuel/air ratio detectors 4, 5 are both connected to a computing element 6 such as a programmed processor suited to monitor the evolution of the fuel/air ratio difference between their respective measurements.

The soot that accumulates in filtering element 1 mainly consists of carbon-containing elements that react with the oxygen and form essentially $CO_2$ and CO therewith. Part of the oxygen entering the filtering element is thus consumed by the carbon present in the deposit. Combustion of the soot in the filtering element thus leads downstream to an oxygen deficit in relation to the fuel/air ratio measured upstream in relation to the direction of flow in the filtering element, from the start of the combustion of the soot.

There are certain engine running conditions (typically high-load running conditions) that allow to reach, without changing any engine parameters, sufficient temperature levels for initiating regeneration of the filter. The computer can then detect the spontaneous filtering element regeneration processes.

Apart from this case of spontaneous regeneration, when the filtering element requires regeneration, computer 6 can initiate the combustion of the soot by controlling, through the agency of any suitable means, a substantial exhaust gas temperature increase. It can be an action on the running parameters of the engine itself, or, in some cases or according to the applications considered, an action on elements exterior to the engine proper (such as heating elements). The device allows to define with precision the time when the regeneration procedure must be stopped and therefore to limit the required energy consumption.

The device must first be calibrated to determine the periodicity of the soot combustion operations in the filter. The amount of soot deposited is either estimated on the basis of engine particle discharge maps, or by using a filter fouling detector of a well-known type.

Integration of the fuel/air ratio difference throughout the soot combustion stage also allows to define the amount of soot accumulated in the filtering element. This value can then be compared with the amount of soot burned on the filter and define whether regeneration of the filter is complete or partial.

Figure 2:
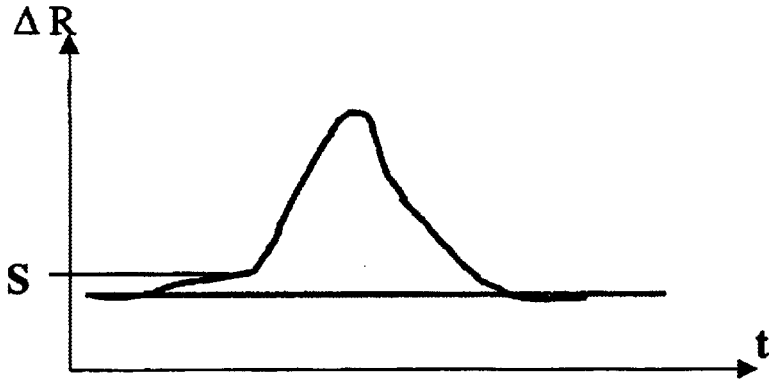
FIG. 2 shows an example of variation with time of the fuel/air ratio difference ΔR between upstream and downstream from the filtering element, with a progressive rise of the difference up to a set threshold value S beyond which combustion of the soot starts.
Figure 3:
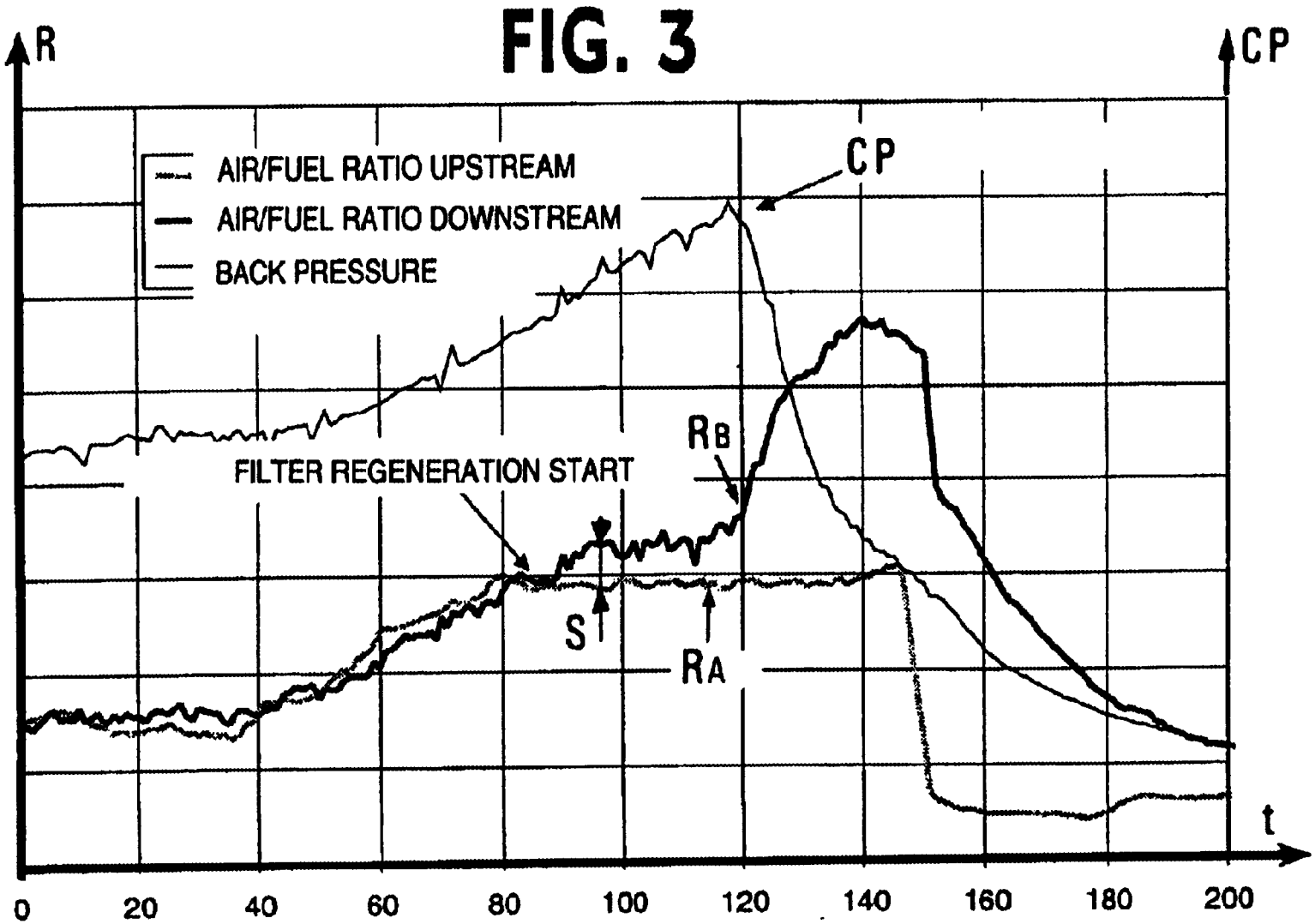
FIG. 3 shows the compared variations, as a function of time, of fuel/air ratio $R_A$ upstream from the filtering element, of fuel/air ratio $R_B$ downstream and of back pressure CP at the exhaust.

FIGS. 2 and 3 show the results of tests carried out on an automobile engine. Curves $R_A$ and $R_B$ show the respective variations of the fuel/air ratio measured by detectors 4 and 5 located upstream and downstream from the filter, whereas curve CP shows the variation of the back pressure at the exhaust. Curves $R_A$ and $R_B$ have a comparable evolution up to point S where the progressive oxidation of the accumulated soot leads to an increasing difference between the fuel/air ratios. It can be observed that maximum D of back pressure CP before the fall takes place long after a significant difference between signals $R_A$ and $R_B$ has appeared.

An example of application of the process to control of the fouling of a filtering element in the exhaust circuits of a thermal engine has been described. It is however clear that the process can be applied to the regeneration of a filtering element accumulating particles carried along in a gaseous stream containing a certain oxygen concentration insofar as these particles are combustible and modify the oxygen content of the stream. Detectors intended to measure the oxygen concentration are used in this case to detect the variation of this concentration.

What is claimed is:

1. A process for controlling the periodic regeneration of a filtering element intended to retain particles carried along by a gaseous stream, by combustion of the particles, characterized in that it comprises detecting the variation in the oxygen concentration of the gaseous stream between at least a first point located upstream from the filtering element receiving the stream, in relation to the direction of flow thereof, and at least a second point located downstream from the first one, resulting from an initiated reaction of combustion of the particles accumulated in the filtering element, so as to adjust with precision the warming up time required for initiation of the combustion and therefore to limit as far as possible the energy required.

2. A process for controlling the periodic regeneration of a filtering element (1) such as an exhaust silencer, intended to retain particles or soot carried along by a gaseous stream flowing out of an engine (3), by combustion of these particles, characterized in that it comprises detecting the variation in the fuel/air ratio of the exhaust gas between at least a first point located upstream from filtering element (1), in relation to the direction of flow, and at least a second point located downstream from the first one, resulting from a reaction of combustion of the particles accumulated in the filtering element, initiated by a management element (6) sensitive to the fuel/air ratio variation detected, so as to adjust with precision the warming up time required for initiation of the combustion, and therefore to limit as far as possible the energy required.

3. A process as claimed in claim 2, characterized in that it comprises detecting the process of spontaneous regeneration of the filtering element.

4. A process as claimed in claim 2, characterized in that it comprises acting on the running parameters of engine (3) in order to obtain a substantial rise in the temperature of the exhaust gas.

5. A process as claimed in claim 2, characterized in that it comprises using heating means associated with the filtering element so as to obtain controlled combustion of the particles.

6. A device for controlling the periodic regeneration of a filtering element (1) that retains particles carried along by a gaseous stream, by combustion of the particles, characterized in that it comprises means (4, 5) for detecting the variation in the oxygen content of the gaseous stream between at least a first point located upstream from the filtering element receiving the stream, in relation to the direction of flow thereof, and at least a second point located downstream from the filtering element, heating means intended to raise the temperature of the filtering element sufficiently to burn the particles, and management means (6) connected to detection means (4, 5) in order to adjust the warming up time required for initiation of the combustion, by acting on said heating means.

7. A device as claimed in claim 6, characterized in that the heating means consist of engine (3), computer (6) being programmed to modify running parameters of engine (3) so as to raise the temperature of the exhaust gas.

8. A device as claimed in claim 6, characterized in that the heating means are associated with the filtering element.

9. A device for controlling the periodic regeneration of a filtering element (1) that retains oxidable particles or soot carried along by a gaseous stream flowing out of an engine (3), by combustion of the particles, characterized in that it comprises a first fuel/air ratio detector (4) arranged at a first point located upstream from filtering element (1), in relation to the direction of flow, and a second fuel/air ratio detector (5) arranged at a second point located downstream from the first one, in relation to the direction of flow of the gas, heating means intended to raise the temperature of the filtering element sufficiently to burn the particles, and a computer (6) connected to detection means (4, 5) in order to adjust the warming up time required for initiation of the combustion, by acting on said heating means, according to the fuel/air ratio variation of the exhaust gas between the first and the second detector.

* * * * *